United States Patent [19]

McFarlane et al.

[11] Patent Number: 4,972,550

[45] Date of Patent: Nov. 27, 1990

[54] FILL OR EFFECT MATERIAL

[75] Inventors: Ian D. McFarlane; Julian M. Watson; Richard J. Walls, all of Christchurch, New Zealand

[73] Assignee: Wool Research Organization of New Zealand Inc., Canterbury, New Zealand

[21] Appl. No.: 392,457

[22] Filed: Aug. 11, 1989

[30] Foreign Application Priority Data

Aug. 12, 1988 [NZ] New Zealand ..... 225818

[51] Int. Cl.[5] ..... D01G 3/00

[52] U.S. Cl. ..... 19/65 R; 19/66 R

[58] Field of Search ..... 19/56, 44–47, 19/66, 66.1, 80, 84, 85, 87, 91, 93, 95, 97, 94; 28/103

[56] References Cited

U.S. PATENT DOCUMENTS

| | | | |
|---|---|---|---|
| 466,669 | 1/1892 | Faulkner | 19/47 |
| 1,180,135 | 4/1916 | Garner et al. | 19/85 |
| 1,971,124 | 8/1934 | Tudor et al. | 19/66 R |
| 1,973,761 | 9/1934 | Hill | 19/66 R |
| 2,373,768 | 4/1945 | McCreery | 19/66 R |

FOREIGN PATENT DOCUMENTS

| | | | |
|---|---|---|---|
| 1301881 | 4/1987 | U.S.S.R. | 19/48 R |

*Primary Examiner*—Werner H. Schroeder
*Assistant Examiner*—John J. Calvert
*Attorney, Agent, or Firm*—Watson, Cole, Grindle & Watson

[57] ABSTRACT

An apparatus for producing, in bulk, long tailed neps, the apparatus including a housing supporting a main rotor the periphery of which has a plurality of teeth and beaters which co-operate with teeth on a set of feed rollers mounted in the housing alongside the periphery of the main rotor, the housing having an intake chute and a closeable discharge door, the arrangement being such that, in use, a synthetic or material fibrous material fed to the intake chute, while the discharge door is closed, is fed into the housing by the feed rollers, the fibrous material being removed by the beaters and teeth of the rotor from the feed rollers, the fibrous material being spun in the housing and the interaction between the teeth and the beaters of the main rotor and the teeth of the feed rollers causing the fibrous material to be entangled and felted to form a plurality of long tailed neps which are discharged from the housing when the discharge door is opened.

11 Claims, 1 Drawing Sheet

FILL OR EFFECT MATERIAL

FIELD OF THE INVENTION

This invention relates to the production of a fill or effect material and more particularly to an apparatus for producing a fill or effect material.

BACKGROUND TO THE INVENTION

The fill or effect materials are long tailed neps and these have been manufactured in the mechanism described in U.S. patent specification No. 4,761,857. The fill or effect material is sold by the applicants licensees under the trade mark "soft knops". The mechanism described in U.S. patent specification No. 4,761,857 is a modified wooden opening mechanism and although the material can be produced satisfactorily on this type of machine there is a need in the market place for a purpose built machine for producing in bulk the long tailed neps.

An object of the present invention is therefore to provide an apparatus for producing in bulk long tailed neps.

Further objects and advantages of the present invention will become apparant from the following description which is given by way of example only.

SUMMARY OF THE INVENTION

According to a broadest aspect of the invention there is provided an apparatus for producing, in bulk, long tailed neps, the apparatus including a housing supporting a main rotor, the periphery of which has a plurality of teeth and beaters which co-operate with teeth on a set of feed rollers mounted in the housing alongside the periphery of the main rotor, the housing having an intake chute and a closeable discharge door, the arrangement being such that, in use, a synthetic or fibrous material fed to the intake chute, while the discharge door is closed, is fed into the housing by the feed rollers, the fibrous material being removed by the beaters and teeth of the rotor from the feed rollers, the fibrous material being spun in the housing and the interaction between the teeth and the beaters of the main rotor and the teeth of the feed rollers causing the fibrous material to be entangled and felted to form a plurality of long tailed neps which are discharged from the housing when the discharge door is opened.

The size of the long tailed neps depends on the degree of mesh of the co-operating teeth and their relative spacing.

The feed rollers can be a set of worker and stripper rollers. One of the stripper rollers can be fluted.

The main rotor is adapted to remove the fibrous material from the feed rollers by providing teeth and flexible beaters on the periphery of the rotor, the teeth and beaters in operation ensure that most of the fibrous material on the worker roller is removed and formed in the housing into the long tailed neps.

Further aspects of the invention which should be considered in all its novel aspects will become apparent from the following description which is given by way of example only.

DESCRIPTION OF THE PREFERRED EMBODIMENT

The embodiment of the invention will now be described with reference to the production of long tailed neps of the type shown in FIG. 5 of U.S. patent specification No. 4,761,857.

Figure 1:
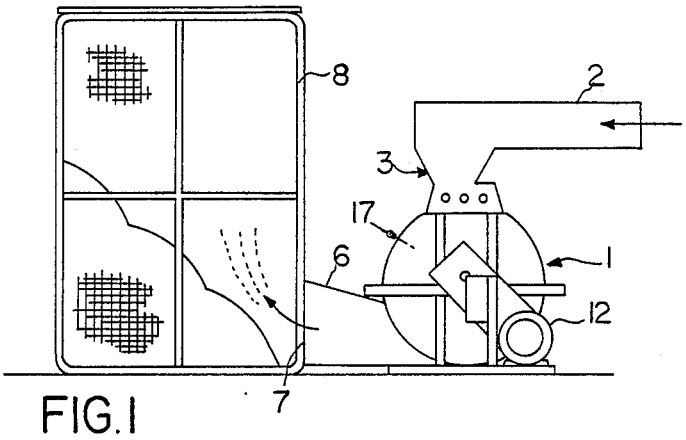
FIG. 1 is in side elevation of an apparatus according to the present invention.
Figure 2:
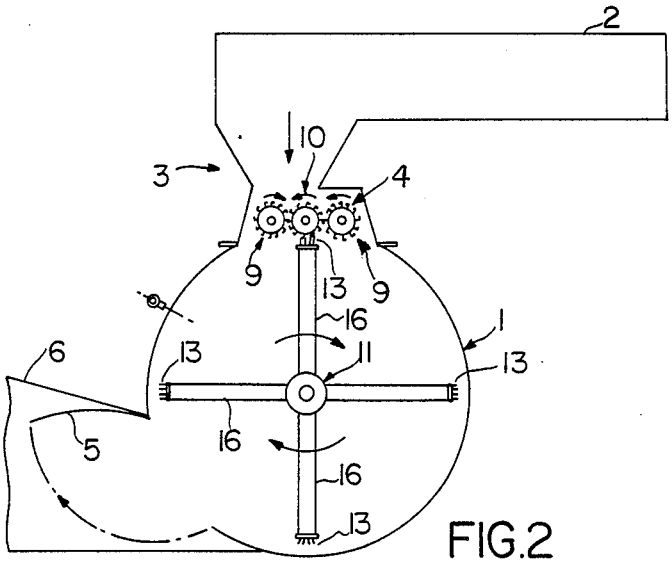
FIG. 2 is a typical section through part of the apparatus shown in FIG. 1.
Figure 3:
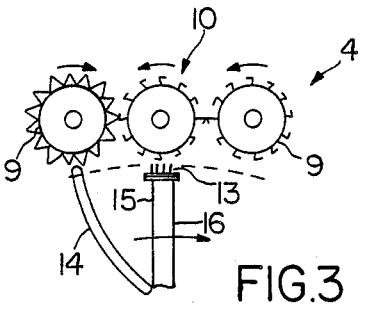
FIG. 3 is a detail on an enlarged scale of the worker and stripper feed rollers interacting with the main rotor.

In the accompanying FIGS. 1 to 3 is shown an apparatus according to the invention which includes a housing 1 which is cylindrical and mounted with its longitudinal axis horizontal.

The housing 1 has mounted across its top an inlet 2 which extends across the full width of the housing 1. The inlet 2 has an intake chute portion 3 at the housing end of which is mounted a set of worker/stripper feed rollers generally indicated by arrow 4 (FIGS. 2 and 3).

The housing 1 has a discharge door 5 which is connected to an outlet chute 6 an open end 7 of which is directed toward a collection cage 8.

In the example a set of three rollers forms the worker/stripper feed rollers 4. The rollers 4 are mounted with their axes horizontal and two of the rollers are stripper rollers 9 between which is a single centrally mounted worker roller 10. The teeth on the rollers 9 and 10 can be hook shaped inside elevation as shown in FIG. 3 and are mounted in parallel rows. The teeth on the rollers 9 and 10 are preferably spaced apart so that the rotating stripper rollers 9 remove fibers from the worker roller 10. Some of the fibers drop into the housing 1.

In an alternative construction (not shown) the feed roller 9 on the discharge door side of the housing 1 is a fluted roller.

The housing 1 has mounted therein a main rotor 11 driven by motor 12. The rotor 11 has a high rotational speed relative to that of the worker and stripper feed rollers. The rotor 11 is preferably driven at about 900 rpm but this depends on the diameter of the rotor or housing and the rotational speed can be varied to suit the end product produced by providing for variations in the rotational speed of the motor 12.

The worker and stripper rollers 10 and 9 respectively rotate at a slow speed and speed thereof is advantageously controlled automatically to ensure an even input of fibers from the intake chute 3 to the housing 1 to ensure that the motor 12 is not overloaded The main rotor 11 has a plurality of teeth 13 which interact with the teeth on the worker roller 10 to remove during processing some of the fibers The main rotor 11 also includes a series of beaters 14 on the trailing edges 15 of the arm 16. The beaters are preferably constructed from a flexible material, for example, strips of leather. As shown in FIG. 3, beaters 14 and teeth 13 are rotated in an opposite direction relative to teeth on worker roller 10. Thus, a coarse carding action occurs between the respective teeth and the beaters whereby the fibrous material is spun in the housing and the interaction of teeth 13 and beaters 14 with the roller teeth cause the fibrous material to become entangled and felted to form a plurality of long tailed neps.

In use the fibrous material to be formed into long tailed neps is fed by a conveyer system or the like to the inlet 2 while the discharge door 5 is in its closed position. The material is fed by the feed rollers 4 into the housing 1. The speed of the feed rollers 4 being adjusted to ensure an even flow and input time. The input time depends on the volume of fibrous material being processed and is ideally over 10 to 20 secs.

The main rotor 11 is operated for a preselected time chosen to suit the type of fibers and volume being processed. The processing time can be from one minute upward. The particular type of long tailed neps to be produced also has a bearing on the process time. While the rotor 11 is operating with the door 5 closed the fibers are continuously caught by the teeth on the rotor 11 and removed thereform by the worker roller 10. The remaining fibers are stripped from the worker 10 by being beaten therefrom by the beaters 14. At the end of the preselected processing time the door 5 is opened and the rotation of the rotor 11 throws the formed long tailed neps through the door 5 into the cage 8.

If desired the processing can include the addition of a lubricant like water to the housing. This water or lubricant can be sprayed into the housing by a boom 17 which extends across the housing 1.

Thus by this invention there is provided an apparatus for producing in bulk long tailed neps.

A particular example of the invention has been described and it is envisaged that improvements and modifications can take place without departing from the scope and spirit of the appended claims.

What we do claim and desire to obtain by Letters Patent of the U.S. is:

1. An apparatus for producing, in bulk, long tailed neps, the apparatus including a housing supporting a main rotor which has on its periphery a plurality of teeth and beaters which cooperate with teeth positioned on a set of feed rollers mounted on the inner periphery of the housing, the housing having an intake chute and a closeable discharge door, the arrangement being such that, in use, a synthetic or material fibrous material fed to the intake chute, while the discharge door is closed, is fed into the housing by the feed rollers, the fibrous material being removed by the beaters and teeth of the rotor from the feed rollers, the fibrous material being spun in the housing and the interaction between the teeth and the beaters of the main rotor and the teeth of the feed rollers causing the fibrous material to be entangled and felted to form a plurality of long tailed neps which are discharged from the housing when the discharge door is opened.

2. An apparatus as claimed in claim 1 wherein the size of the long tailed neps depends on the degree of mesh of the cooperating teeth and their relative spacing.

3. An apparatus as claimed in claim 2 wherein the feed rollers comprise a set of worker and stripper rollers.

4. An apparatus as claimed in claim 1 wherein the main rotor is adapted to remove the fibrous material from the feed rollers by providing teeth and flexible beaters on the periphery of the rotor, the teeth and beaters in operation ensure that most of the fibrous material on the worker roller is removed and formed in the housing into the long tailed neps.

5. An apparatus as claimed in claim 4 wherein the housing is cylindrical and is mounted with its longitudinal axis horizontal.

6. An apparatus as claimed in claim 5 wherein the housing has mounted across its top a full width inlet having the intake chute at its base, the set of feed rollers being mounted in the intake chute.

7. An apparatus as claimed in claim 6 wherein the set of rollers comprise a pair of horizontally mounted stripper rollers between which is a single centrally mounted worker roller.

8. An apparatus as claimed in claim 7 wherein the teeth on the rollers are hook shaped in side elevation and are mounted in parallel rows.

9. An apparatus as claimed in claim 8 wherein the worker and stripper rollers are rotated at a shower speed relative to that of the main rotor.

10. An apparatus as claimed in claim 9 wherein the main rotor includes in addition to its plurality of teeth a series of beaters constructed from a flexible material.

11. An apparatus as claimed in claim 8 wherein the main rotor rotates at a speed of approximately 900 rpm.

* * * * *